United States Patent [19]

Mason, Jr.

[11] 3,954,178

[45] May 4, 1976

[54] CONTAINER COVER

[76] Inventor: Stanley I. Mason, Jr., 61 River Road, Weston, Conn. 06880

[22] Filed: Aug. 2, 1974

[21] Appl. No.: 493,881

[52] U.S. Cl. ..... 206/508; 206/509; 206/821; 229/1.5 B; 229/DIG. 11

[51] Int. Cl.[2] ..... B65D 21/00; B65D 85/62

[58] Field of Search ..... 206/508, 821, 509; 229/DIG. 11, 1.5 B; 220/23.6, 380; 217/66, 67, 68

[56] References Cited

UNITED STATES PATENTS

| | | | |
|---|---|---|---|
| 1,490,973 | 4/1924 | Hodgson | 206/821 |
| 2,156,583 | 5/1939 | Chaplin | 206/821 |
| 2,429,958 | 10/1947 | Liebmann | 206/508 |
| 3,091,361 | 5/1963 | Gawron | 206/508 |
| 3,240,610 | 3/1966 | Cease | 206/508 |
| 3,266,623 | 8/1966 | Poferl | 206/821 |
| 3,384,265 | 5/1968 | Frank | 206/508 |
| 3,391,850 | 7/1968 | Torgerson et al. | 206/508 |
| 3,598,271 | 8/1971 | Holley | 206/509 |

*Primary Examiner*—William Price
*Assistant Examiner*—Joseph M. Moy
*Attorney, Agent, or Firm*—Haynes N. Johnson

[57] ABSTRACT

An improved disposable container cover for use with recessed-bottom frusto-conical containers includes annular projection means on its surface which will fit into the recessed bottom of an adjacent like container in telescopic forceful frictional engagement. The projection means is resilient and of diameter greater than the inner diameter of the container recessed bottom and deforms upon pressure of interengagement therewith to fit therein. Upon release of this pressure the projection means seeks to expand to its original diameter and siezes the recessed bottom to permit stable stacking of a plurality of containers. In another embodiment, an annular projection secures the exterior of a flat-bottomed container. A stack of containers may be secured by a binding strap which fits into recesses on the container cover periphery to maintain alignment and permit spill-proof carrying thereof.

7 Claims, 10 Drawing Figures

66
62
64
68
70
60
10
24
30
30'
44
40
12
16
28
32
80
10'
16'
12'
18'
20'
82
84
48
46

CONTAINER COVER

BACKGROUND OF THE INVENTION

This invention relates to disposable container covers and more particularly to an improvement in the structure of container covers making it possible to securely interlock a plurality of disposable containers and container covers to form a stable stack.

Disposable containers are finding increasing use in the sale of beverages and other food products for consumption at a location other than the place of sale. For example, throw-away containers made of impregnated paper, plastic and the like materials are widely used in vending machines to contain hot and cold drinks and liquid food products such as soups and the like, as well as take-out counters of restaurants and in fast food outlets. These containers are generally of recessed-bottom, frusto-conical design and are provided at the place of sale with container covers or lids of plastic material which contain a groove that snaps over the container lip to seal it and prevent the contents within from spilling.

It frequently occurs that sales of food products in containers of the type described to one individual customer involve a plurality of containers. In such instances it is desirable to have a convenient means of carrying or transporting a plurality of containers without the risk of dropping them or spilling their contents. Thus, for example, fast food outlets generally provide the consumer with a tray prepared from a flat cardboard fold-out into which cups and other containers may be placed. However, such trays hold only the amount of containers that will fit on the tray surface and thus take up a considerable surface area compared to the containers held. In addition, the cardboard trays and the like are themselves an extra expense and also create additional disposal problems.

Recessed-bottom, frusto-conical containers of the type generally used for the disposable variety are stored, prior to use, as a stack of nested containers. See, for example, U.S. Pat. No. 3,139,213. The stacking of sealed containers designed for marketing food products and other commodities, such as conventional metal cans, on the shelves of grocery stores and supermarkets is also known. In U.S. Pat. No. 3,091,361, there is disclosed a sealed container wherein top and bottom walls are designed in such a way that they may be stacked one within the other so as to positively preclude the stacked containers from slipping laterally relative to one another. The patent discloses that the end walls of the container are designed so that a portion of one end wall may be inserted into a portion of the other end wall of a duplicate container for such stacking. The containers shown are cylindrical and may be used for marketing paints and heavy type liquids.

However, the container structure of U.S. Pat. No. 3,091,361 does not provide the most advantageous mode for stacking containers of the disposable variety which are subject to all manner of handling and not mere shelf stacking. Thus, the container of U.S. Pat. No. 3,091,361, does not provide firm interengagement between containers since the end walls that insert into one another are of a dimension such that one is smaller than the other and freely fits into it.

Thus, there has not heretofore been suggested any means for providing stable stacking of filled and covered frusto-conical disposable containers for convenient storage and carrying thereof. My invention provides such an advantage by providing a resilient container cover having a structure which permits the telescopic insertion of a portion of the container cover about the bottom of a duplicate container to tightly interengage it through the release of elastic forces within the container cover upon firm telescopic positioning.

SUMMARY OF THE INVENTION

According to my invention there is provided a means for achieving the advantage of a stable stack of covered containers of the frusto-conical disposable type through the provision of a resilient container cover having a central projecting portion on its surface which telescopically engages in tight frictional fitting relationship with the bottom of a like container stacked thereon. The projecting portion of the container cover surface is so dimensioned relative to the bottom of the container about which it fits so that it is deformed upon the pressure of interengagement so as to be enabled to be fitted in telescopic relationship therewith. Upon release of the pressure of interengagement, the elastic forces in the resilient cover cause it to seek to return to its original shape, thus forming a tight frictional engagement which is not easily removed by mere tilting of the stack.

Thus, an object of my invention is the provision of a disposable container cover which will enable tight frictional interengagement of adjacent stacked containers and container covers to provide a stable stack which will not separate upon rough handling or transportation.

The container covers may be provided with shaped projections oppositely disposed on their periphery defining a recess which can receive a strap or other binding means for securely binding together a stack of sealed containers. In this way, the containers may be so securely fastened together that they may be disposed at any angular relationship to the horizontal and even placed on their side without fear of spillage of their contents. The strap or binding means secured around the stack may include further means which project into the recessed-bottom of the bottommost container to maintain it in firm placement in the stack and insure that it does not shift from under the stacked containers.

Thus, it is a further object of my invention to provide a stack of disposable containers securely fastened together by binding means.

Another object of this invention is the provision of a binding strap for fastening a plurality of stacked containers together to permit transportation of the same without spillage.

BRIEF DESCRIPTION OF THE DRAWINGS

The foregoing advantages and objects of my invention will be more apparent and better understood from a consideration of the following detailed description in connection with the accompanying drawings of an embodiment thereof in which.

DETAILED DESCRIPTION OF THE DRAWINGS

Figure 1:
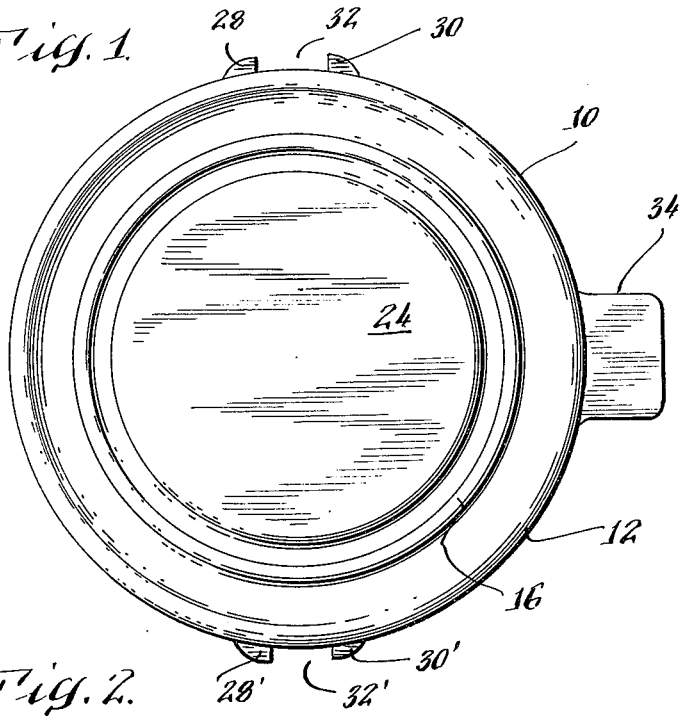
FIG. 1 is a top view of a container cover constructed in accordance with an embodiment of the present invention.
Figure 2:
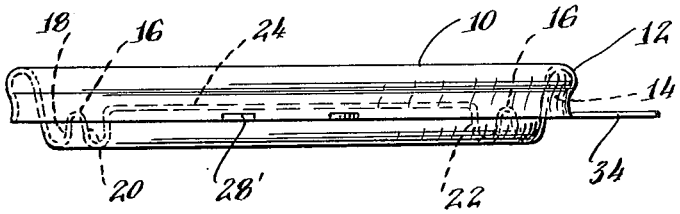
FIG. 2 is a side view, partly in cross-section, of the container cover shown in FIG. 1.

Referring to FIGS. 1 and 2, there is shown a container cover 10 constructed of flexible resilient plastic or like material and formed by vacuum forming, blow molding, die shaping or by other conventional means from a single sheet of plastic or like material. The container cover 10 has a circular channel rim 12, the channel 14 of which is of a shape and size to snugly fit the lip 42 of a disposable container 40, as is common in the art, of the type shown in FIG. 3. The central portion of the container cover 10 includes an upstanding or upwardly projecting annular lip 16 formed by reversely bending the central portion of the container cover material to provide annular lip walls 18 and 20. Also upwardly projecting from the central portion of the container cover 10 is an upstanding annular flange 22 which is integral with the projecting flat circular portion 24. The annular upstanding flange 22 and the wall 20 of the annular lip 16 define between them a groove 26 into which may fit, as will be described in greater detail hereinafter, the bottom wall of a recessed-bottom, frusto-conical disposable container.

Also seen in FIGS. 1 and 2 is another aspect of the container cover 10 of my invention, namely, the oppositely disposed projections 28 and 30 and 28′ and 30′. Projections 28 and 30 and 28′ and 30′ define between them recesses 32 and 32′ which receive the binding strap for a stack of containers as will be described hereinafter. A tab 34 permits easy removal of the container cover from a container.

Figure 3:
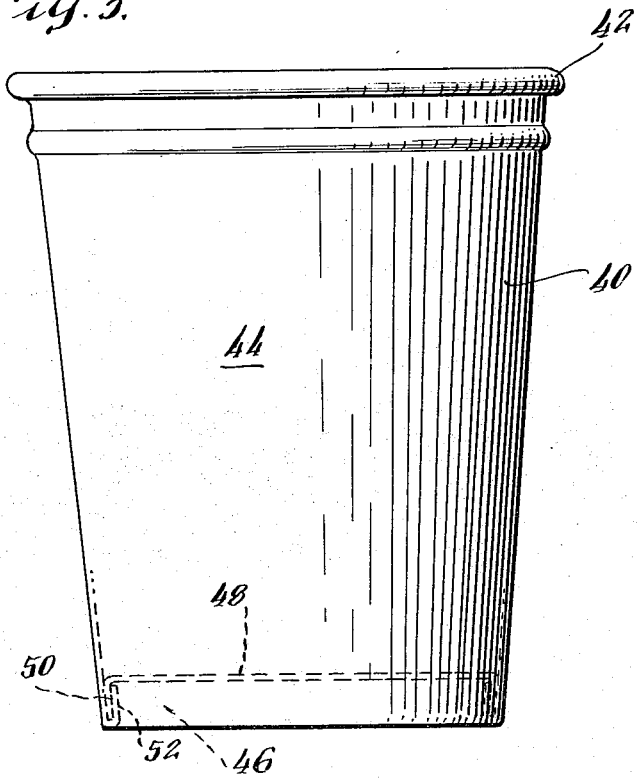
FIG. 3 is a side view of a recessed-bottom, frusto-conical container of the disposable type currently in wide use.

FIG. 3 shows a frusto-conically shaped container 40 of the type commonly used as a disposable container for beverages and other food products. The container 40 has a body 44 and an annular lip 42 which is received in the channel 14 of the container cover 10 for tight sealing engagement. The frusto-conical container body 44 has a recessed-bottom, shown generally at 46, including a plane recessed-bottom surface 48 with a flange portion 50 secured by the reversely bent container bottom wall 52.

Figure 4:
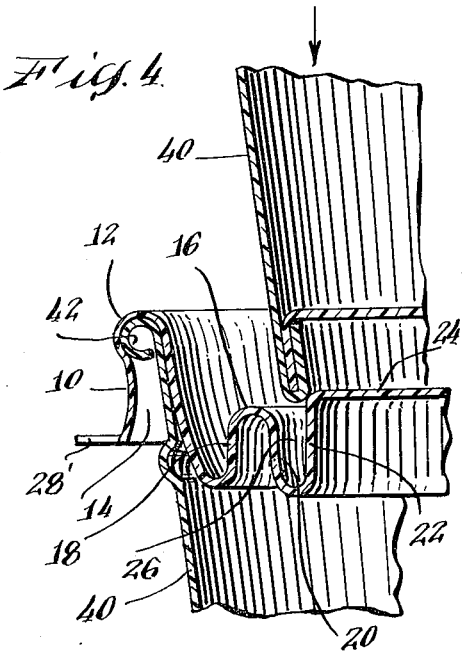
FIG. 4 is an enlarged cross-sectional view through a container of the type shown in FIG. 3 sealed with a container cover, as shown in FIGS. 1 and 2, and showing the manner in which another container is disposed in relation thereto for interengagement stacking.
Figure 5:
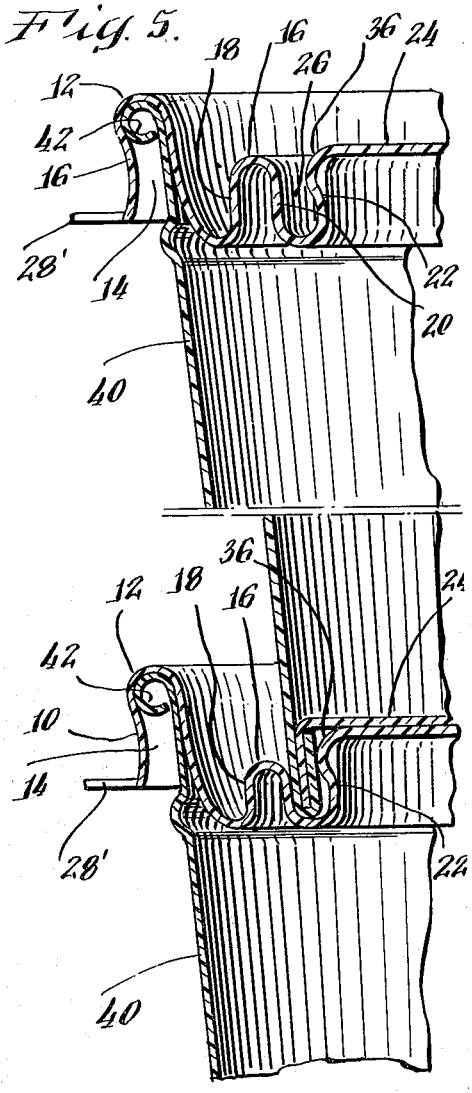
FIG. 5 is an enlarged cross-sectional view showing a plurality of containers in stable stacked relationship.

FIGS. 4 and 5 illustrate the manner in which the container cover 10 provides firm telescopic interengagement and frictional interlocking with the recessed-bottom 46 of another container. Referring to FIG. 4, there is seen the relative alignment of a container cover 10 and the recessed-bottom 46 of a container 40 which is to be stacked on top of the container cover for telescopic interengagement. The annular upstanding flange 22 and its flat surface 24 which forms a plateau-like projection in the central portion container cover is of a diameter greater than the inside diameter of the recessed bottom 46 of the container at its smallest diameter point at the bottom of the container. As the container 40 is pressed down upon this portion of the container cover 10 for telescopic interengagement material in the groove 26 begins to deform and stretch while the container bottom wall 52 is being pressed into it. This deformation uniformly reduces the diameter of the flange 22 so that it can fit within the recessed bottom 46. This deformation occurs because the material is resilient and because of the unique construction of the container cover central portion which provides "excess" material in the annular lip 16 and the flange 22 and surface 24. Thus, under the pressure of interengagement the annular lip 16 is decreased in height and "yields" material while the flange 22 and surface 24 yield material which reduces the diameter of the flange 22.

Upon release of the pressure of interengagement, the groove 26 and surrounding rim 16 and flange 22, being resilient and containing elastic forces, seek to return to their normal positions and there is an increase in diameter of the flange 22 to cause tight frictional engagement with the bottom wall 52 of the container 40. Thus, not only is there a telescopic relationship between the container cover and recessed bottom of an adjacent container but also a tight fit arising from the elastic forces in the container cover exerting themselves on the container bottom wall.

The tight frictional engagement between the flange 22 and the bottom wall 52 of the recessed portion of the container 40 is such that the cover and container will not separate even if turned completely over. This is believed to be due to forces in the material which are released upon release of the pressure of interengagement to cause the flange diameter to expand to seize the bottom wall and fit tightly. These forces resist any pulling off of the container and in fact in an attempt to remove the container through an upward pulling, the forces remain in effect. However, the container may be easily removed from the container cover by simply twisting it off. The container bottom and the projection of the container cover are shown in tight seizure as indicated in the bottom of FIG. 5.

Also shown in FIG. 5 is another embodiment of the container cover 10 which may contain small detents or bump-like projections 36 on the periphery of the flange 22. These projections 36 may be provided at spaced angular locations, advantageously at three or more, to accommodate any tolerance differences in the bottom wall 52 the recessed bottom 46 of the container. The function of interengagement when these projections 36 are present remains described above.

Figures 6, 7, 8, 9, 10:
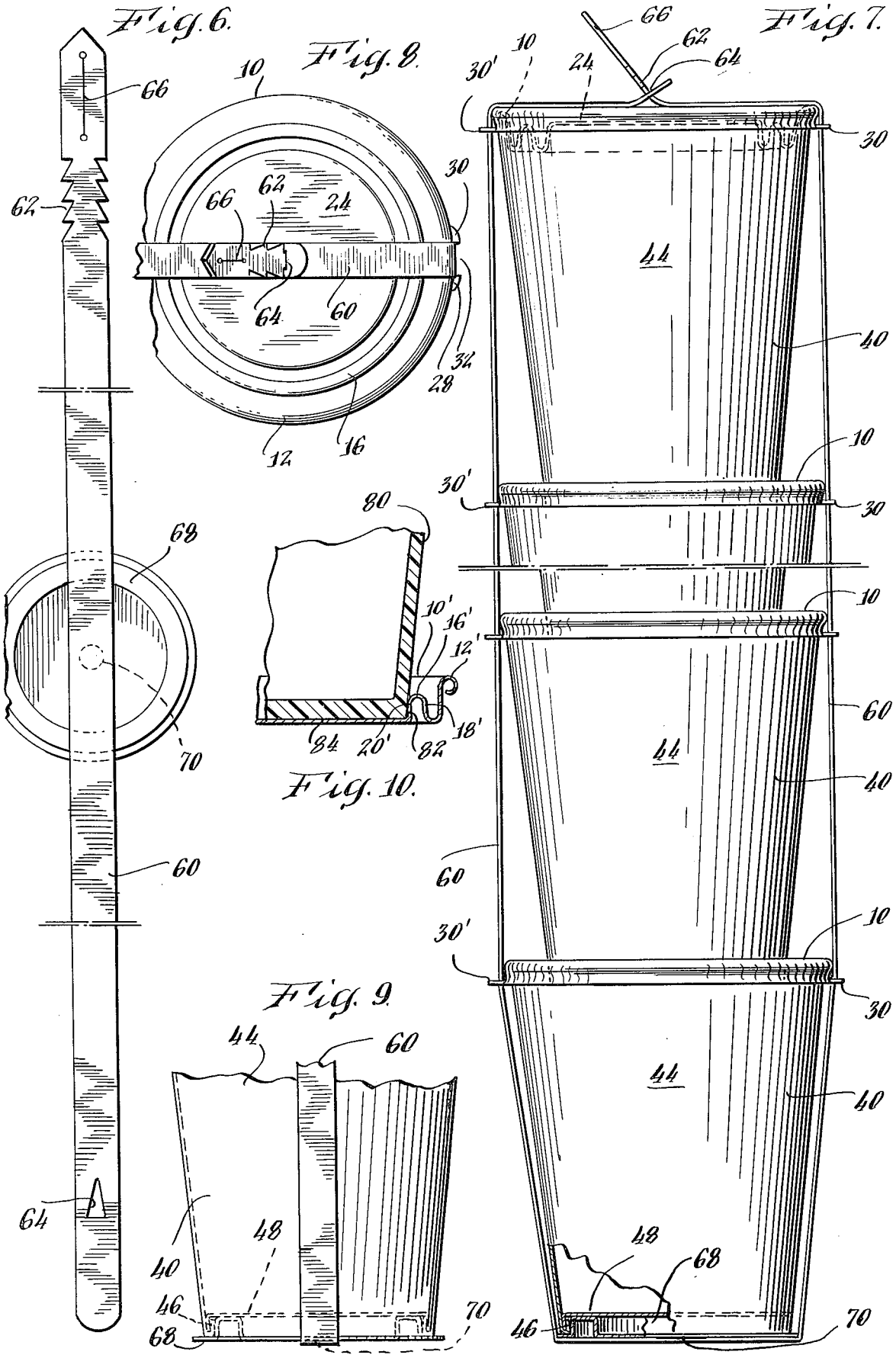
FIG. 6 is a top view of a binding strap according to an embodiment of this invention usable for binding a plurality of stacked containers in stable relationship.
FIG. 7 is a side view of a plurality of stacked containers showing the use of the binding strap of FIG. 6.
FIG. 8 is a top view of the stack of containers shown in FIG. 7.
FIG. 9 is a side view, in detail, of the stack of FIG. 7 showing the bottom container and means for securing the strap thereto to prevent misalignment.
FIG. 10 is a side-sectional view, in detail, of a flat bottomed container in interengagement with a container cover constructed in accordance with another embodiment of the present invention.

In FIG. 6 there is shown a strap 60 which may be made out of flexible material such as plastic and the like. The strap 60 has a toothed portion 62 which together with angular opening 64 can form a closure when the toothed portion 62 is placed through the opening 64 as seen in FIGS. 8 and 9. The strap 60 also has a finger hole 66, the function of which will be later described. The strap 60 contains an annular flanged plug-like means 68 which, as seen in FIGS. 7 and 9 projects into the bottom of the bottommost container when the strap is placed around a stack of containers.

It is possible to carry a plurality of stacked containers by merely one finger or on a belt or yoke or other single carrying means as may be used by a vender in a sports arena according to my invention by stacking the containers and placing the strap 60 around them. The strap 60 passes through the recesses 32, 32' of each container cover formed by the projections 28, 28' and 30, 30' of each container cover 10 to assure that no container can slide out of alignment in the stack. In addition, the plug-like means 68 as shown in FIG. 7, projects into recessed-bottom of the bottommost container to maintain it in firm placement in the stack and insure that the bottommost container does not shift from under the stacked containers.

FIGS. 6, 9 and 10 illustrate the manner in which the plug-like means 68 may be secured to the strap 60. The strap 60, which may be of die cut flexible plastic material has the plug-like means 68, which may be formed by thermo-forming and the like, secured to it in fixed position by ultrasonic spot welding or adhesive, as shown at 70.

FIG. 10 shows another embodiment of a container cover according to my invention. Illustrated in FIG. 10 is a flat bottom container 80 having a bottom wall 82 surrounding a flat bottom 84 secured thereto, shown here as a one-piece construction as is generally found in containers fabricated of foamed plastic material. The container cover 10' shown in FIG. 10 is similar to the container cover 10 previously described and has like parts numbered corresponding with prime numbers except that the laterally extending projecting portion formed by flange 22 and surface 24 on the cover surface is not present with the cover 10', thus making it advantageously suitable for use with flat bottomed containers.

The operative function is identical as that previously described resulting in tight frictional interengagement. In the embodiment shown in FIG. 10, the inner diameter of annular projection 16' is smaller than the diameter of the bottom wall 82 of the container 80. The projection 16' deforms upon insertion of the container therein and the resilient walls 18' and 20' yield to accommodate the container bottom. Projections such as 36 shown in FIG. 5 may also be provided. A recessed-bottom container may also be so stacked since the projection 16' seizes the bottom exterior in the embodiment. A container cover which seizes both the interior and exterior is within the scope of this invention and combines the above disclosure.

This described method of stacking and securing containers is particularly advantageous together with the container covers providing frictional interengagement, as previously described. While there has been described an embodiment having projections 16 or 16' to provide material for resilient yielding for frictional engagement, it is to be understood that other configurations or structures permitting such yielding are within the scope of this invention. For example, the projection 16 may be minimized or eliminated when excess material for resilient yielding is provided by other means such as in the flange 22 which may both stretch and/or compress resiliently. The stacking method may also be advantageously utilized with container covers which do not provide such frictional interengagement since the strap itself will help maintain them secure.

I claim:

1. In a flexible container cover of the type frictionally engaging the rim of a frusto-conical, recessed bottom, disposable container to seal the contents therein, the improvement comprising resilient means for forcefully frictionally engaging the circumferential bottom flange of the recessed bottom of another like container to provide a stable stacking relationship of two or more containers, said means comprising an annular upwardly projecting means, the annular projecting means normally having a diameter slightly greater than the inside diameter of the circumferential bottom wall of the other like container, the annular projecting means deforming and having a diameter less than the inside diameter of the circumferential bottom wall when pressure is applied downwardly on the groove means enabling the annular projecting means to be inserted in telescopic relationship within the recessed bottom, the annular projecting means seeking to return to its normal diameter upon release of the pressure and when pressure is applied upwardly and thus forcefully frictionally engage the circumferential bottom wall to provide stable stacking relationship therewith.

2. In a flexible container cover of the type frictionally engaging the rim of a frusto-conical disposable container to seal the contents therein, the improvement comprising resilient means for forcefully frictionally engaging the circumferential bottom wall of the bottom of another like container to provide a stable stacking relationship of two or more containers, said means comprising an annular upwardly projecting means formed by a reverse bend in the material in the center portion of the container cover, the projecting means having an inside diameter slightly less than the outside diameter of the circumferential bottom wall of the other like container, the projecting means deforming and having a diameter greater than the outside diameter of the circumferential bottom wall when pressure is applied downwardly in the vicinity thereof enabling the circumferential bottom wall and annular projection to interengage in telescopic relationship, the annular projecting means seeking to return to its normal diameter upon release of the pressure and when pressure is applied upwardly and thus forcefully frictionally engage the circumferential bottom wall to provide stable stacking relationship therewith.

3. A stack of containers having covers comprising a plurality of adjacent frusto-conical containers secured maintained together through forceful frictional engagement between means projecting from the surface of a cover of one container and in telescopic relationship with the bottom of a like container, said means comprising an annular upwardly projecting means, the annular projecting means normally having a diameter slightly greater than the inside diameter of the circumferential bottom wall of the other like container, the annular projecting means deforming and having a diameter less than the inside diameter of the circumferential bottom wall when pressure is applied downwardly on the groove means enabling the annular projecting means to be inserted in telescopic relationship within the recessed bottom, the annular projecting means seeking to return to its normal diameter upon release of the pressure and when pressure is applied upwardly and thus forcefully frictionally engage the circumferential bottom wall, the container cover including projection means defining recesses on the periphery thereof, the container being surrounded by a binding strap means which fits into the container cover recesses and the binding strap means being secured to maintain the plurality of containers in tight, aligned, adjacent stacked relationship.

4. A stack of containers having covers as claimed in claim 3 wherein the binding strap means includes a strap having projection means on the surface thereof, the projection means being dimensioned and located to project into the recessed bottom of the bottommost container of the stack to maintain it in firm placement free from shifting.

5. In a flexible container cover of the type frictionally engaging the rim of a frusto-conical, recessed bottom, disposable container to seal the contents therein, the improvement comprising resilient means for forcefully frictionally engaging the circumferential bottom flange of the recessed bottom of another like container to provide a stable stacking relationship of two or more containers, said means comprising a first annular upwardly projecting means formed by a reverse bend in the material in the center portion of the container cover, a second annular upwardly projecting means, the first and second means defining between them an annular groove means for receiving the circumferential bottom wall of the recessed bottom of the other like container, the second projecting means normally having a diameter slightly greater than the inside diameter of the circumferential bottom wall of the other like container, the second projecting means deforming and having a diameter less than the inside diameter of the circumferential bottom wall when pressure is applied downwardly on the groove means enabling the second projecting means to be inserted in telescopic relationship within the recessed bottom, the second projecting means seeking to return to its normal diameter upon release of the pressure and when pressure is applied upwardly and thus forcefully frictionally engage the circumferential bottom wall to provide stable stacking relationship therewith.

6. The improved container cover as claimed in claim 5 wherein the second projection means includes angularly spaced bump-like projection means for accommodating any tolerance variation in the inside diameter of the circumferential bottom wall.

7. The improved container cover as claimed in claim 5 further including projection means defining recesses on the periphery thereof.

* * * * *